US005745536A

United States Patent [19]

Brainard et al.

[11] Patent Number: 5,745,536

[45] Date of Patent: Apr. 28, 1998

[54] SECONDARY ELECTRON ION SOURCE NEUTRON GENERATOR

[75] Inventors: John P. Brainard; Daryl R. McCollister, both of Albuquerque, N. Mex.

[73] Assignee: Sandia Corporation, Albuquerque, N. Mex.

[21] Appl. No.: 659,695

[22] Filed: Jun. 5, 1996

[51] Int. Cl.[6] ..... G21K 5/00

[52] U.S. Cl. ..... 376/114; 376/108

[58] Field of Search ..... 376/108, 114, 376/115, 116, 144; 250/423 R, 427

[56] References Cited

U.S. PATENT DOCUMENTS

| | | | |
|---|---|---|---|
| 3,581,093 | 5/1971 | Carr | 376/116 |
| 3,786,258 | 1/1974 | Schmidt | 376/114 |
| 4,529,571 | 7/1985 | Bacon et al. | 376/108 |
| 5,293,410 | 3/1994 | Chen et al. | 376/114 |

OTHER PUBLICATIONS

Brainard, J.P., et al., "Single-ring Magnetic Cusp Ion Source," *Rev. Sci Instrum*, vol. 54, No. 11, pp. 1497–1505 (1983).

Burns, E.J,T., et al., A Solenoidal and Monocusp Ion Source (SAMIS), *Rev. Sci. Instrum*, vol. 67, No. 2 p. 1 (1996) incomplete copy.

*Primary Examiner*—Daniel D. Wasil
*Attorney, Agent, or Firm*—George H. Libman

[57] ABSTRACT

A neutron generator employing an electron emitter, an ion source bombarded by the electrons from the electron emitter, a plasma containment zone, and a target situated between the plasma containment zone and the electron emitter. The target contains occluded deuterium, tritium, or a mixture thereof

21 Claims, 3 Drawing Sheets

SECONDARY ELECTRON ION SOURCE NEUTRON GENERATOR

GOVERNMENT RIGHTS

The U.S. Government has rights to this invention pursuant to Contract Nos. DE-AC04-76DP00789 and DE-AC04-94AL85000 between the U.S. Department of Energy and Sandia Corporation.

BACKGROUND OF THE INVENTION

1. Field of the Invention

The present invention relates to sealed neutron generators and to their employment in fast neutron activation analysis of substances and treatment of medical conditions.

2. Background Art

Sealed neutron generators known in the art are described in publications including Burns et al, "A solenoidal and monocusp ion source (SAMIS)", *Rev. Sci. Instrum.* 67(2), page 1 (Feb. 1996); U.S. Pat. No. 4,529,571, to Bacon et al, entitled "Single-Ring Magnetic Cusp Low Gas Pressure Ion Source", issued Jul. 16, 1985; and Brainard et al, "Single-ring magnetic ion source", *Rev. Sci. Instrum.* 54(11), page 1497 (November 1983). The use of such generators for both medical and substance analysis applications is well known.

Fast neutron activation analysis uses either 14 or 2.5 MeV neutrons that are generated in a sealed tube from the acceleration of deuterium or tritium ions onto a deuterium or tritium target. Neutron activation excites or produces nuclear reactions with constituent elements and the resultant gamma ray or neutron spectrum from the deexcitation or nuclear reactions can identify the elements. Fast neutron activation analysis with sealed neutron generators has been used to detect oil (oil logging), hazardous waste, fissile material, explosives, and contraband (drugs), and to measure body fat, sulfur in coal, and constituents in cement, and to conduct neutron radiography.

Although the applications of neutron generators are widespread, the benefits from their use have been denied in many instances due to the high cost of existing generators (approximately $100,000). This is in large part due to complexity of design of existing generators.

The present invention provides a secondary electron ion source neutron generator of a much simpler design than existing generators, resulting in the availability of generators at approximately $10,000 or less per generator. This will permit larger field studies and commercial applications than heretofore possible. The present invention also has a number of additional advantages over the prior art, including programmability of neutron output pulse width and the period between pulses.

SUMMARY OF THE INVENTION

The present invention is a relatively small neutron generator comprising: an electron emitter; an ion source bombarded by electrons from an electron emitter; a plasma containment zone within the ion source; and a target, comprising occluded hydrogen, situated between the plasma containment zone and the electron emitter, the hydrogen being deuterium, tritium, or a mixture thereof. In the preferred embodiment, the electron emitter and target are at or near ground potential and the ion source is at high positive potential. The plasma containment zone preferably comprises: an upper plasma boundary where ions begin to be accelerated towards the target; a lower plasma boundary which is conductive to set the plasma potential near the high positive potential (preferably a hydrogen occluder such as zirconium which will release hydrogen gas when heated with electrons); and a secondary electron source (such as one or more ceramic posts and an outer ceramic cylinder). The secondary electrons are produced at the ceramic surfaces by the bombardment of electrons from the electron emitter. The neutron generator requires only passive thermal conduction for cooling while in operation. Preferably the ion source comprises an occluder such as zirconium in which hydrogen is embedded, the hydrogen being deuterium, tritium, or a mixture thereof, and wherein the occluder need be heated only by electron bombardment directly or indirectly from the electron emitter for the hydrogen to be released from the occluder in quantities sufficient to produce sufficient neutrals for secondary electron ionization, whereby the ions are accelerated to the target to generate neutrons. The electron emitter is heated indirectly, thereby permitting a vacuum within the neutron generator to exist without vacuum feedthrough means. The neutron generator may be pulsed, such as by biasing the electron emitter; although this embodiment requires a feedthrough. Electrons released by ion bombardment of the target enhance secondary electron ionization within the plasma containment zone.

The present invention is also a neutron generator comprising an electron emitter and a target comprising occluded hydrogen, the hydrogen being deuterium, tritium, or a mixture thereof, with both the electron emitter and the target being at or near ground potential.

The invention is further a neutron generator comprising a gated electron emitter which is pulsed. In the preferred embodiment, the pulsing occurs by biasing the emitter and a single vacuum feedthrough is employed to maintain a vacuum within the neutron generator while biasing the emitter.

The invention is additionally a neutron generator comprising a neutron generator powered by two power supplies (a heater for the electron emitter and a high voltage supply to accelerate ions into the target and electrons into the ion source) both operating the neutron generator at approximately 100 watts or less.

The present invention is further a neutron generator comprising a device for cooling the neutron generator comprising only passive thermal conduction for cooling while the neutron generator is in operation.

The present invention is also a neutron generator comprising a device within the neutron generator for producing secondary electrons to enhance ionization. In the preferred embodiment, the secondary electrons are produced by one or more secondary electron posts and an outer ceramic cylinder situated within a plasma containment zone, or by a ceramic block with one or more bores therein. Low energy secondary electrons are produced at the ceramic surface from the high energy electron bombardment of electrons from the electron emitter. The low energy electrons are required for efficient ionization of the gas.

The invention is still further a neutron generator comprising: a plasma containment zone, an outer boundary of which comprises a grid; a post within a cylinder situated within the plasma containment zone; and a magnetic field encompassing the plasma containment zone. In the preferred embodiment, the post and cylinder comprise a refractory ceramic, such as alumina. Preferably, the post and cylinder are at the floating potential of the plasma but may be biased by using a semiconductor coating (such as titanium) to permit the post and cylinder to be at or near anode potential. The magnetic field forms a magnetic cusp at the lower boundary of the plasma containment zone.

A primary object of the present invention is to provide a neutron generator which is less expensive by an order of magnitude than existing designs.

Another object of the present invention is to provide for programmability of neutron output pulse width and period.

An additional object of the present invention is to provide a neutron generator which does not result in employee safety and health risks from radioactive tritium exposure, because any tritium is held in occluders.

A primary advantage of the present invention is that it is operated at low power, with inexpensive, off-the-shelf power supplies.

An additional advantage of the present invention is that it requires as few as eight (8) parts, as opposed to the forty (40) parts now required by some commercial neutron generators.

Another advantage of the present invention is that because the electron emitter which indirectly ionizes the gas is at the target rather than the ion-source end, ions do not sputter the emitter, resulting in substantially longer generator life.

Yet another advantage of the present invention is that the target can be placed at ground potential so that samples can be placed closer to the target for a higher neutron flux.

Other advantages of the present invention include: fewer feedthroughs required, smaller size due to a smaller source, reduced target field and high voltage breakdown with the smaller source, resulting in improved reliability and manufacturability.

An additional advantage of the present invention is that ionization from electrons released at the target by ion bombardment provide additional secondary electrons which improve ionization efficiency.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate the present invention and, together with the description, serve to explain the principles of the invention. The drawing is only for the purpose of illustrating a preferred embodiment of the invention and is not to be construed as limiting the invention. In the drawing.

DESCRIPTION OF THE PREFERRED EMBODIMENTS

The present invention is an improved neutron generator. As in most existing generators, a mixture of deuterium and tritium gas is ionized in an ion source and then accelerated to 50–200 eV to a target which is hydrided with a mixture of deuterium and tritium. The collision of deuterium on tritium or tritium on deuterium produces neutrons with a relative high yield ($10^{13}$ neutrons/sec-amp). The advantages of the present invention are primarily due to placement of an electron emitter at the target rather than the ion-source end. At the target end, electrons are accelerated to high energy to the ion source where low-energy secondary electrons are produced to ionize the deuterium-tritium gas mixture.

Figure 1:
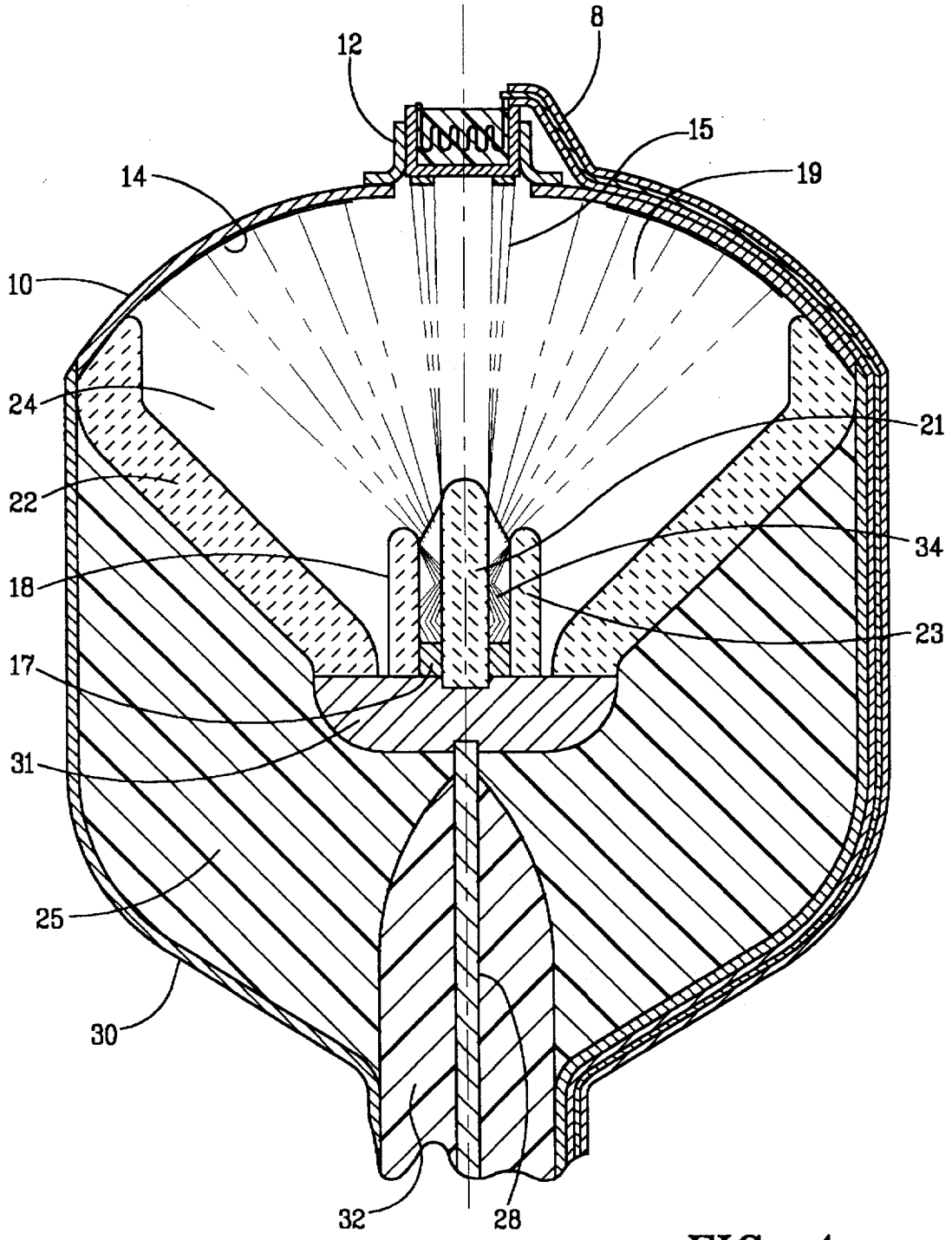
FIG. 1 is a vertical sectional view of a preferred secondary ion source neutron generator of the invention.

Referring to FIG. 1, the preferred secondary electron ion source neutron generator 10 of the invention comprises electron emitter 12, which includes a heater, for generating electrons at an interior surface of generator 10. One end of the heater may connect to a ground such as the surface 30 of generator 10; the other end of the heater is connected to a current source through an insulated wire 8. A secondary electron source structure 18 at an interior portion of generator 10 releases low energy secondary electrons 34 when bombarded by the high energy electrons accelerated from emitter 12 along trajectory 15. Structure 18 preferably includes a central ceramic post 21 surrounded by an outer ceramic cylinder 23 (preferably of a refractory ceramic such as alumina) and is maintained at plasma floating potential or near anode potential by means of a semiconductive film such as titanium. An occluder 17, formed of a material such as zirconium, stores deuterium and/or tritium between cylinder 23 and post 21. Interaction of the secondary electrons from structure 18 with the deuterium/tritium mixture from occluder 17 produces a plasma which is confined within the vicinity of structure 18 by the plasma boundary that naturally forms between plasma and accelerating fields where electrons are reflected back into the plasma and ions are accelerating towards the target.

Structure 18 is held within generator 10 by a conventional high voltage insulator 22 and a metal end cap 31. Insulator 22 is preferably made of a material, such as ceramic, designed to prevent high voltage breakdown (HVB). For the embodiment of FIG. 1, metal end cap 31 may be of any metal. The interior volume 24 of generator 10 defined by target 14, emitter 12, structure 18, and insulator 22 is evacuated and preferably contains approximately 20–30μof deuterium/tritium mixture. The remainder of generator 10 may include encapsulant 26, preferably having good thermal conduction, positive high voltage lead 28 for applying a positive voltage to secondary structure 18 through metal end cap 31, a ground shield 30, preferably constructed of metal, surrounding generator 10, and high voltage cable insulation 32. The diameter of generator 10 is on the order of 5 cm.

In addition, a target 14, formed on the interior surface of generator 10, is preferably an occluder such as zirconium containing a deuterium/tritium mixture. Target 14 is shaped as a disk having a hole centered over electron emitter 12, whereby electrons pass through the target to secondary structure 18 to produce plasma as discussed above. Ions are accelerated from the plasma boundary at structure 18 to target 14 along trajectories 19. These ions interact with the hydrogen isotopes at target 14 to produce the desired neutrons. These neutrons are directed isotropically from the target. The target electrons generated from the ion impact are attracted to secondary structure 18 along trajectories 19.

Figure 2:
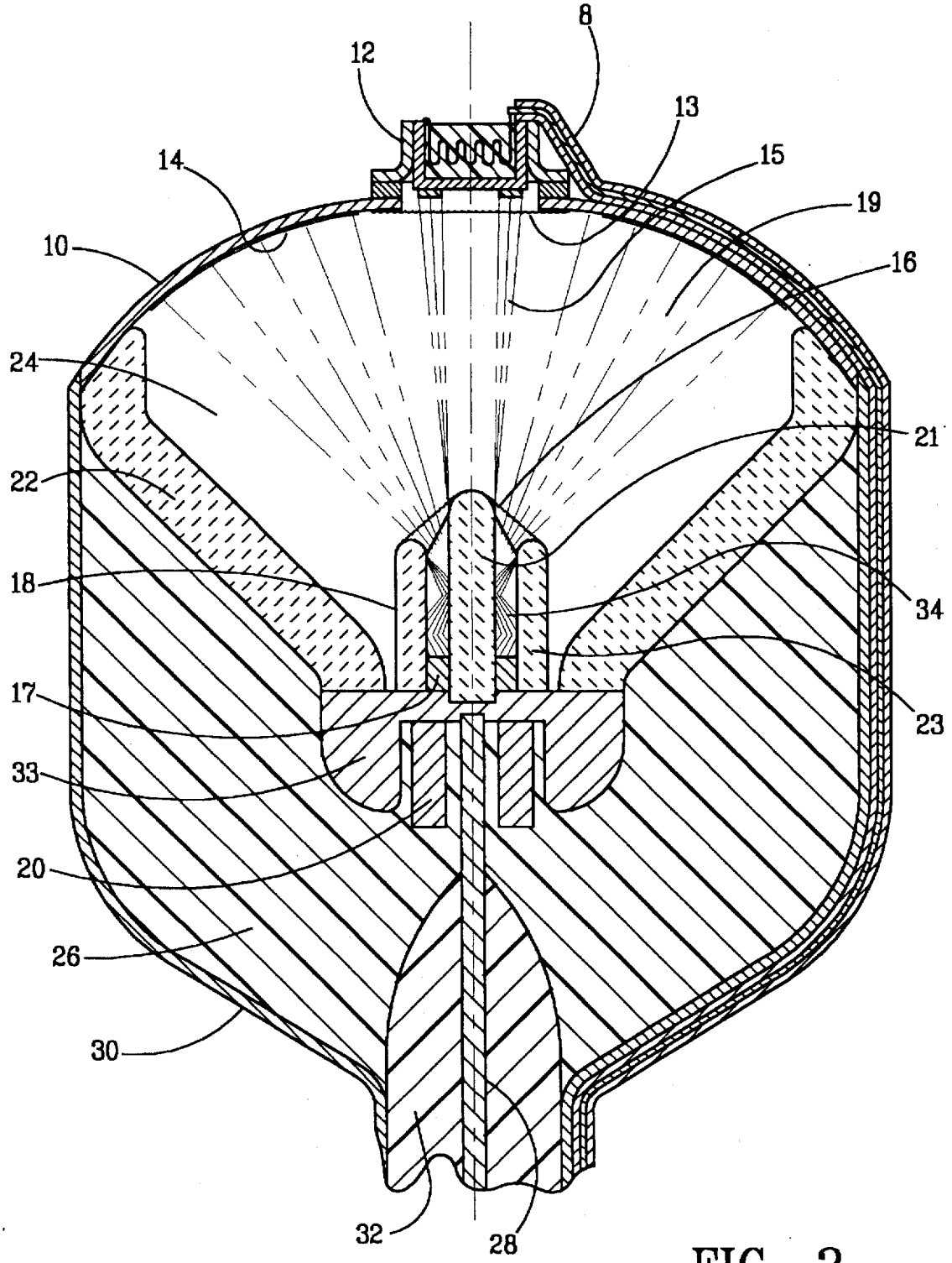
FIG. 2 is a schematic of another embodiment of the invention.

In the alternative embodiment of FIG. 2, additional components are added to the embodiment of FIG. 1. Insulator 11 and grid 13 at the opening in target 14 may be provided to pulse the high energy electron beam 15 from emitter and heater 12, thereby permitting pulsed operation of the device. Furthermore, an optional open grid 16 at the secondary structure 18 acts to more precisely define the plasma boundary to help distribute ions to target 14. In addition, an optional magnetic field generator 20, such as a permanent magnet located at metal end cap 33 improves ionization efficiency by trapping the low energy electrons between the magnetic cusp and the plasma boundary within the source structure. When magnetic field generator 20 is present, metal end cap 33 must be made of a non-magnetic metal such as aluminum or stainless steel.

The design of the present invention leads to the following significant advantages: Ions do not sputter the emitter, which increases the emitter life and therefore the life of the generator. The secondary electrons produce a wider range of electron energies required for atomic ion production; atomic ions produce neutrons more efficiently at the target. The source end can be made smaller than in previously known devices because of the absence of an electron emitter at that end and, therefore, the generator can be made smaller than heretofore. The smaller ion source allows for a spherical geometry to reduce the target fields, which is where most breakdowns are initiated, which improves reliability. The target is preferably placed at ground potential because there is no external power input at the ion source end, and neutron irradiated samples can be placed closer to the target for higher neutron flux. No vacuum feedthrough is required for DC currents (indirectly heated emitter 12), which simplifies manufacturing and improves reliability. DC power supplies are preferably employed for the high voltage and electron emitter (dissipating 100 watts or less within the neutron tube). The tube may be pulsed by biasing the electron emitter, but this will require one vacuum feedthrough.

The invention has some important design considerations: electrons from the electron emitter must graze the side walls of the secondary electron source structure to maximize secondary electron production. Accordingly, the side walls of cylinder 23 and post 21 may preferably taper. Also, care must be taken to avoid concentrating the power density of the electrons to prevent melting of the source structure. For example, electron emitter 12 may be hollow as shown in FIGS. 1 and 2. Electron and ion trajectory codes should be employed to provide this capability. The electrons generated at the target by ion bombardment and accelerated to the source aid gas ionization at the source by producing additional secondary electrons. Neutron output is programmable by programming the bias of the electron emitter. Finally, as a safety feature, the tritium/deuterium gas mixture is stored in an occluder (preferably metal) and released only during generator operation when the occluder is heated by the emitted electrons. This prevents escape of radioactive tritium if the tube is ruptured while not in use.

Figure 3:
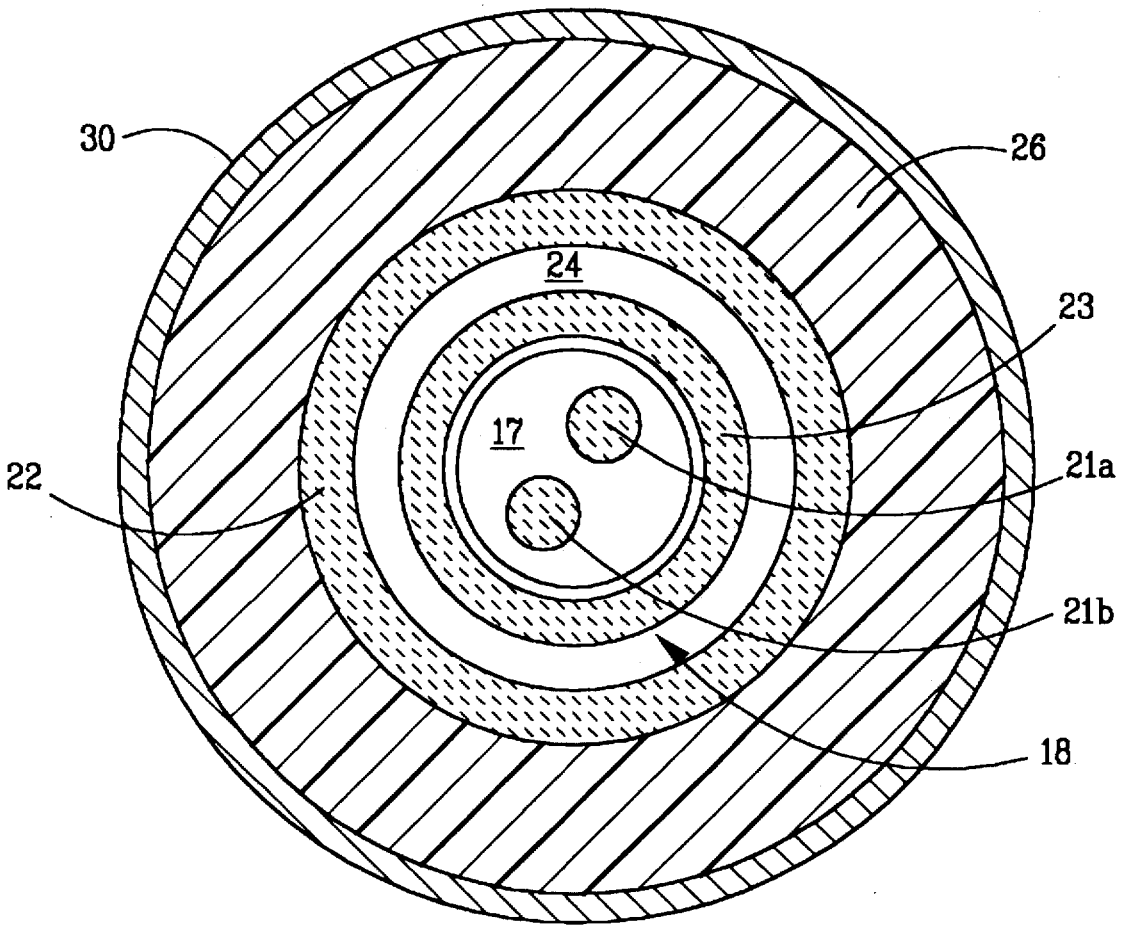
FIG. 3 shows a horizontal sectional view of the neutron generator of FIG. 1 with an alternative construction of the secondary electron source of the invention.

FIG. 3 shows a second embodiment of secondary structure 18 to include an outer cylindrical ring 23 including a tapered inner surface, as discussed above, and a plurality of posts 21*a*, 21*b*. The lower end of each of cylinder 23 and posts 21*a*, 21*b* is connected to a metal end cap (hidden in this figure) and the space between cylinder 23 and the posts contains an occluder material 17 as discussed above. Although two posts are shown in this embodiment, any number of posts that fit within cylinder 23 may be utilized in the practice of the invention.

Figure 4:
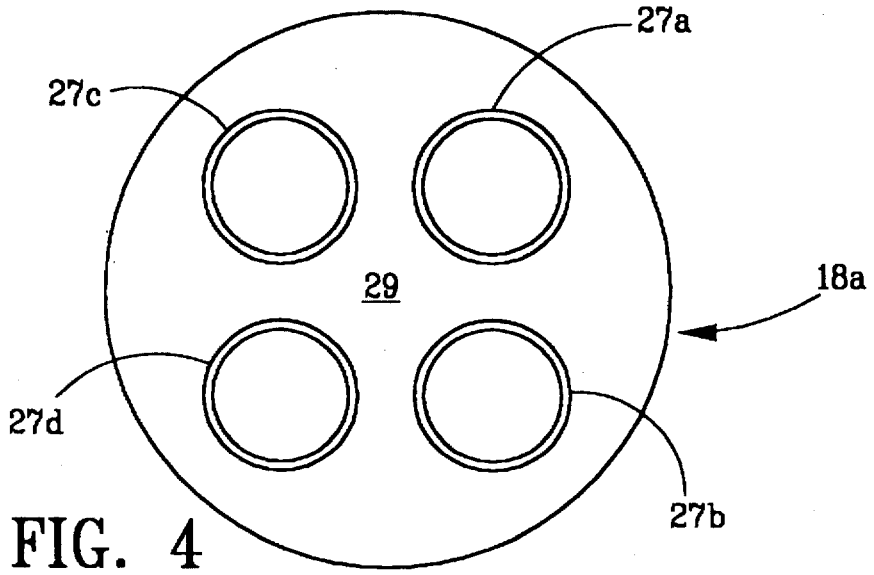
FIG. 4 shows a horizontal view of a third embodiment of the secondary electron source of the invention.

FIG. 4 shows a top view of a third embodiment of the secondary structure which consists of a cylindrical ceramic block 18*a* having a vertically raised central portion 29 and one or more bores 27*a*–27*d* extending the length of block 18*a*. As shown, each bore preferably tapers from a larger diameter at the top to a smaller diameter. In operation, block 18*a* rests on an end cap (not shown) and occluder material is placed on the end cap within the smaller diameter of each bore.

Other alternatives to the preferred design include the following: One or more target electron emitters may be used at any position behind the target, so long as holes are provided in the target for passage of electrons. The hemispherical target and source ends may be of a different shape, e.g., planar or cylindrical, rather than the spherical geometry of FIG. 1. Target fields would, however, be greater. The preferred embodiment produces an ion beam of a few mA using a few hundred mA of target emitted electrons. In this way, a complex cooling system is avoided. Nearly $10^8$ neutrons per second can be obtained for 100 kV ions. Pulsed beam currents can be much greater as long as the average power is less than 100 watts. These currents and neutron output can, of course, be increased with the presence of a cooling system.

Although the invention has been described in detail with particular reference to these preferred embodiments, other embodiments can achieve the same results. Variations and modifications of the present invention will be obvious to those skilled in the art, and it is intended to cover in the appended claims all such modifications and equivalents.

What is claimed is:

1. A neutron generator comprising:

a housing having a grounded outer shell;

an electron emitter adjacent said shell for emitting electrons into said housing;

ion source means within and electrically insulated from said outer shell for producing ions when bombarded by electrons from said electron emitter; and target means within said housing and spaced between said electron emitter and said ion source means for producing neutrons when struck by said ions.

2. The neutron generator of claim 1 wherein said electron emitter is grounded.

3. The neutron generator of claim 1 wherein said target is grounded.

4. The neutron generator of claim 3 wherein said ion source means is at a positive high voltage with respect to ground.

5. The neutron generator of claim 4 wherein said ion source means comprises:

secondary electron source means for generating secondary electrons when struck by electrons from said emitter; and occluder means for holding occluded hydrogen, said occluder means creating a plasma when heated to outgas and ionized by the secondary electrons; whereby ions are accelerated from said plasma to said target.

6. The neutron generator of claim 5 further comprising:

a conductive end cap;

electric insulating means for supporting said end cap within said shell; wherein said secondary electron source means comprises at least one ceramic post surrounded by and spaced from an outer ceramic cylinder, each of said post and said cylinder having a lower end affixed to said end cap and an upper end, each upper end being closer to said target than each lower end.

7. The neutron generator of claim 6 wherein said occluder means is located between said post and said cylinder at said end cap, the plasma being generated between said cylinder and said post.

8. The neutron generator of claim 7 wherein said ion source means further comprises a grid defining an upper plasma boundary.

9. The neutron generator of claim 8 wherein said ion source means additionally comprises a magnetic field beneath said secondary electron source for holding secondary electrons within said ion source means.

10. The neutron generator of claim 6 wherein said secondary electron source means comprises a ceramic block comprising one or more bores therein.

11. The neutron generator of claim 5 wherein said hydrogen for said occluder is selected from the group consisting of deuterium, tritium, and mixtures thereof, and wherein said occluder need be heated only by electron bombardment from said electron emitter for said hydrogen to be released from said occluder in quantities sufficient to produce sufficient neutrals for electron ionization and neutron generation.

12. The neutron generator of claim 1 wherein said electron emitter is heated indirectly, thereby permitting a vacuum within said neutron generator to exist without vacuum feedthrough means.

13. The neutron generator of claim 1 additionally comprising means for pulsing said neutron generator.

14. The neutron generator of claim 13 wherein said means for pulsing said neutron generator comprises grid means adjacent said emitter for biasing said emitter.

15. The neutron generator of claim 1 wherein said target comprises occluded hydrogen, and electrons released by said target from ion bombardment are attracted to said ion generation means enhance secondary electron ionization within said plasma.

16. The neutron generator of claim 1 further comprising means for cooling said neutron generator consisting of only passive thermal conduction.

17. The neutron generator of claim 5 wherein said secondary electron source comprises a refractory ceramic.

18. The neutron generator of claim 17 wherein said secondary electron source comprises alumina.

19. The neutron generator of claim 5 wherein said secondary electron source is at a floating potential of the plasma.

20. The neutron generator of claim 17 wherein said secondary electron source comprises a semiconductor coating to permit said secondary electron source to be at or near anode potential.

21. The neutron generator of claim 20 wherein said coating is titanium.

* * * * *